US005313728A

United States Patent [19]

Tien

[11] Patent Number: 5,313,728

[45] Date of Patent: May 24, 1994

[54] ACTION DOLL

[76] Inventor: Chen F. Tien, P.O. Box 82-144, Tiapei, Taiwan

[21] Appl. No.: 926,933

[22] Filed: Aug. 10, 1992

[51] Int. Cl.[5] ..... G09F 19/08

[52] U.S. Cl. ..... 40/420; 446/286; 40/414

[58] Field of Search ..... 446/429, 280, 286, 288; 40/414, 420, 429, 418, 411

[56] References Cited

U.S. PATENT DOCUMENTS

| | | | |
|---|---|---|---|
| 94,058 | 8/1869 | Allen | 446/286 |
| 439,866 | 11/1890 | Devore | 40/418 X |
| 624,799 | 5/1899 | Haueis | 40/411 X |
| 1,356,901 | 10/1920 | Barger | 446/280 |
| 2,488,483 | 11/1949 | Thatcher | 40/429 |
| 2,585,467 | 2/1952 | Huth | 40/418 |
| 2,709,601 | 5/1955 | Goerditz | 446/280 X |
| 2,835,995 | 5/1958 | Eickemeyer | 40/429 |
| 4,260,041 | 4/1981 | Mabuchi | 446/429 X |

*Primary Examiner*—Peter R. Brown
*Assistant Examiner*—J. Bonifanti
*Attorney, Agent, or Firm*—Alfred Lei

[57] ABSTRACT

This invention relates to an action doll and in particular to an action doll which includes a base in which are mounted a motor, a transmission mechanism, a friction wheel, and a battery chamber, a bicycle having a front wheel engaged with the friction wheel and a time clock at a hind part thereof, and a doll having two feet engaged with pedals of the front wheel of said bicycle, whereby the doll may ride the bicycle as a human being and may produce music as desired hence making the toy funny and interesting.

1 Claim, 3 Drawing Sheets

ACTION DOLL

BACKGROUND OF THE INVENTION

It is found that most toy dolls are dull and monotonous. Hence, such toys are often played for a very short time and then thrown away thereby wasting money.

Therefore, it is an object of the present invention to provide an action doll which may obviate and mitigate the above-mentioned drawbacks.

SUMMARY OF THE INVENTION

This invention relates to an action doll.

It is the primary object of the present invention to provide an action doll which may ride a bicycle as a human being.

It is another object of the present invention to provide an action doll which may produce music as desired.

It is still another object of the present invention to provide an action doll which is turned on by a time clock.

It is still another object of the present invention to provide an action doll which is simple in construction.

It is a further object of the present invention to provide an action doll which is funny and interesting.

Other objects and merits and a fuller understanding of the present invention will be obtained by those having ordinary skill in the art when the following detailed description of the preferred embodiment of the invention is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
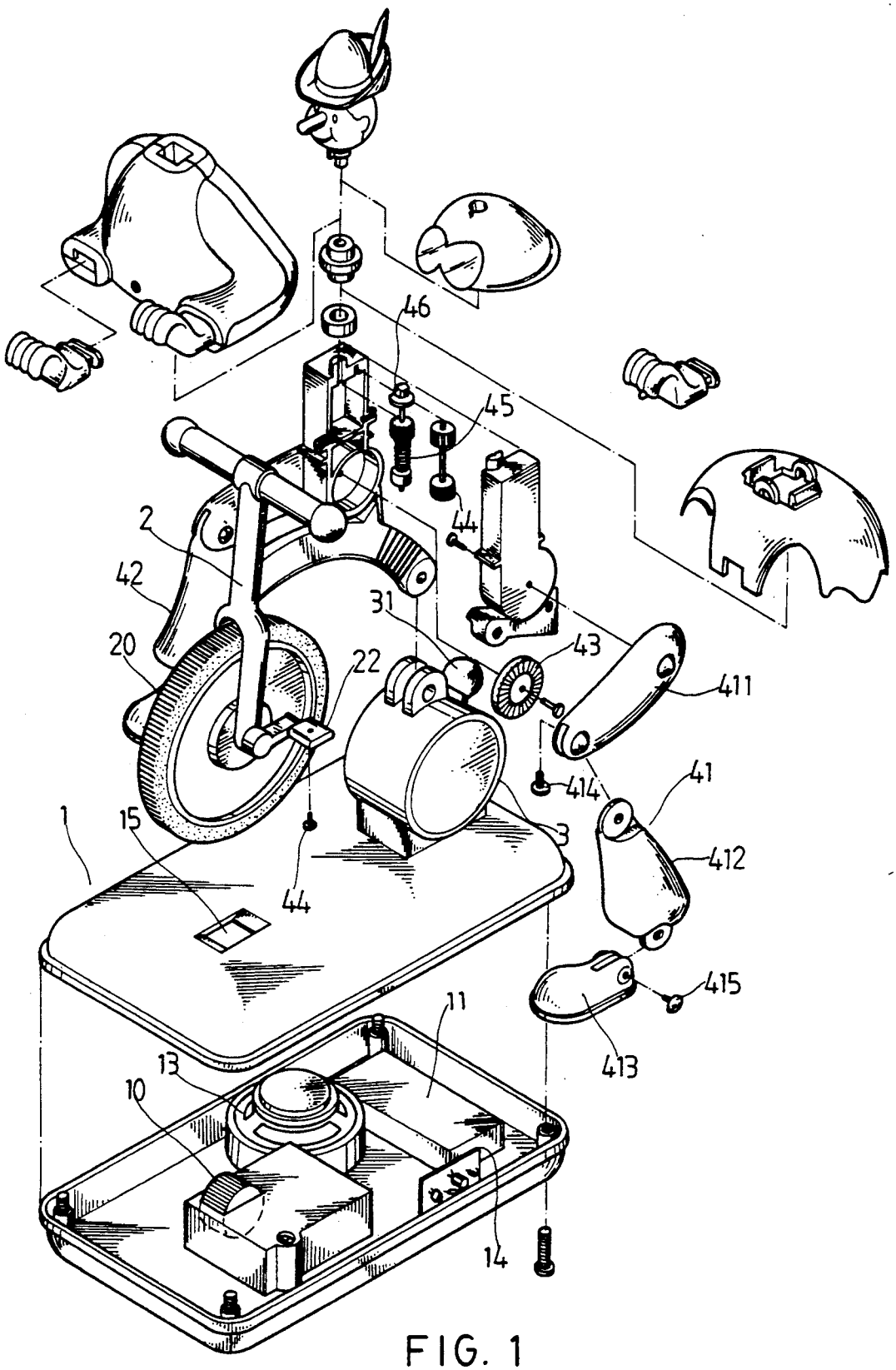
FIG. 1 is an exploded view of an action doll according to the present invention.
Figure 2:
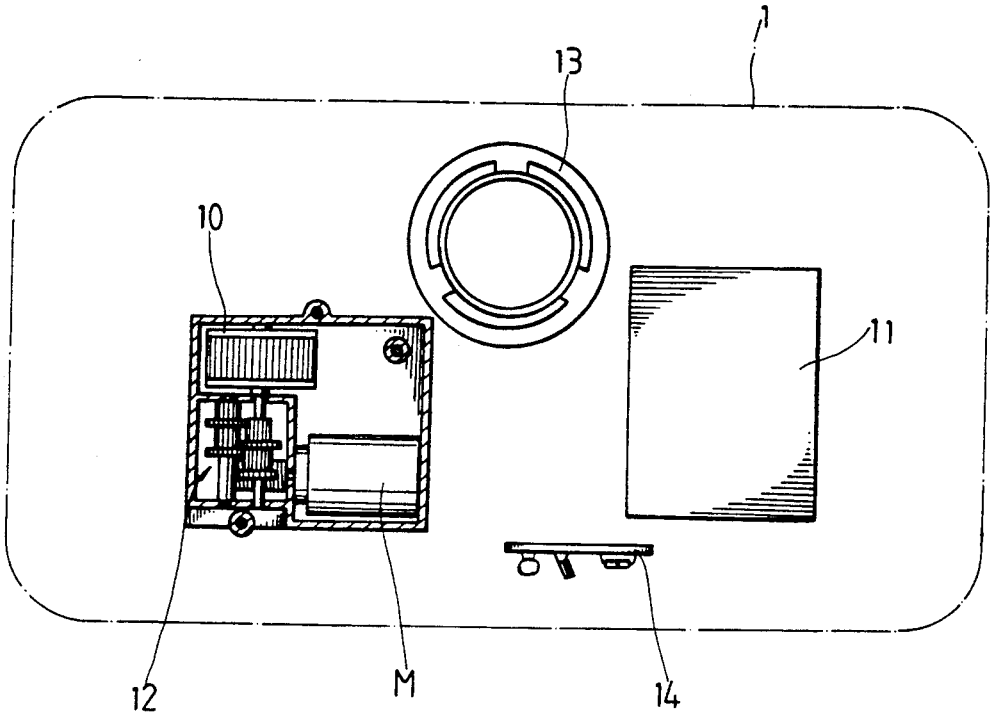
FIG. 2 shows the structure of the transmission mechanism.

With reference to the drawings and in particular to FIGS. 1 and 2 thereof, the action doll according to the present invention mainly comprises a base 1 and a bicycle 2 mounted on the base 1. The bicycle 2 has a front wheel 20 formed with threads engaged with a friction wheel 10 disposed in a slot 15 on the top of the base 1.

A time cock 3, which is used as a rear wheel, is mounted at the hind part of the bicycle 2. The time clock 3 is provided with a button 31 for producing music and turning on a motor. A doll 4 is fitted on the bicycle 2.

Within the base 2, there is a transmission mechanism which is constituted by a motor M, a gearing 12, a friction wheel 10, a battery chamber 11, a loudspeaker 13 and a printed circuit board 14. The printed circuit board 14 is triggered by the time clock 3, of which the principle is well known in the art and has no need to be described here in detail.

Figure 3A:
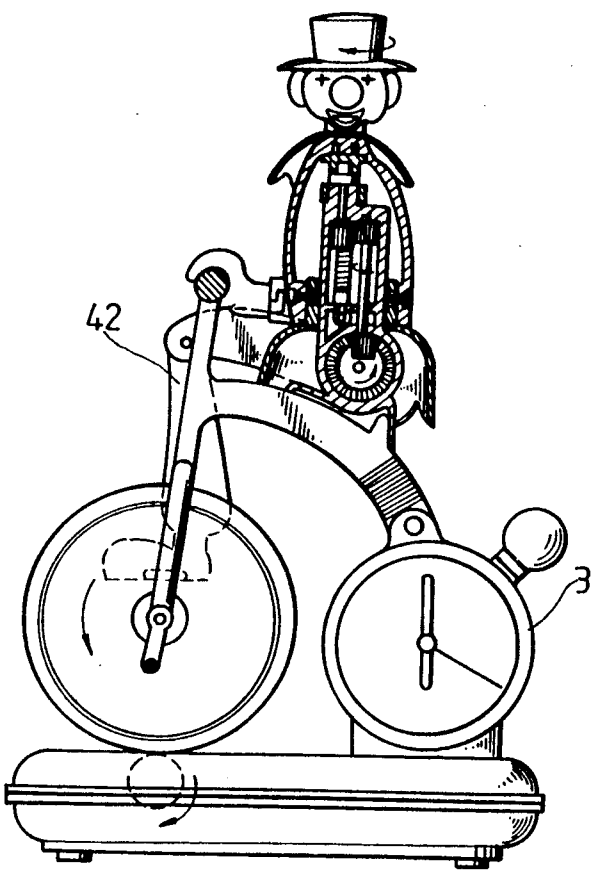
FIGS. 3 and 3A show the working principle of the present invention.
Figure 3:
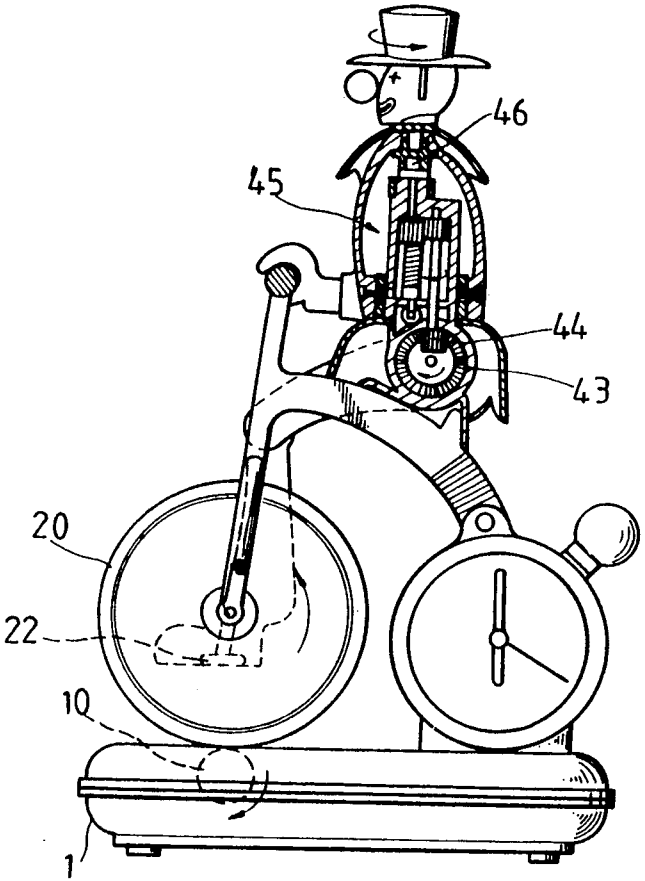

The doll 4 has two feet 41 and 42 riding on the pedals 22 of the front wheel 20. The upper portion of the right foot 42 of the doll 4 is connected with a ratchet wheel 43 which is in turn connected with a gear 44 of a driving gear train 45 mounted within the body of the doll 4. As the left foot 41 of the doll 4 is moved up and down by the front wheel 20 driven by the friction wheel 10, the ratchet wheel 43 will rotate counterclockwise (with respect to FIGS. 1 and 3A) hence rotating the head of the doll via the gear 44 and a pin 46 of the driving gear train 45 (see FIG. 3A). Further, in order to make the doll 4 ride as a human being, the leg of the doll 4 is formed of a thigh 411, a calf 412 and a foot 413. The thigh 411 and the calf 412 are mounted on the body of the doll 4 by screws 414 while the foot 413 is engaged with the pedal 22 of the front wheel 20 by a pin 415.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An action doll comprising:

a base in which are mounted a transmission mechanism and a battery chamber, said transmission mechanism including a motor electrically connected with said battery chamber, a gearing driven by said motor, and a friction wheel connected with said gearing;

a bicycle having a front wheel formed with threads engaged with said friction wheel and a time clock at a hind part of said bicycle, said time clock being electrically connected with said motor and provided with a knob for controlling said motor and including means for producing music; and a doll having two legs with feet engaged with pedals of the front wheel of said bicycle, one of said legs being engaged with a ratchet wheel which is in turn engaged with a driving gear train for rotating a head of said doll;

whereby actuation of the motor will rotate the front wheel and its associated pedals, which, in turn, will move the feet of the doll, resulting in a rotation of the head of the doll through the gear train.

* * * * *